United States Patent [19]

Garg

[11] 4,411,767

[45] Oct. 25, 1983

[54] INTEGRATED PROCESS FOR THE SOLVENT REFINING OF COAL

[75] Inventor: Diwakar Garg, Macungie, Pa.

[73] Assignee: Air Products and Chemicals, Inc., Allentown, Pa.

[21] Appl. No.: 429,390

[22] Filed: Sep. 30, 1982

[51] Int. Cl.[3] ..... C10G 1/08

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 2,227,672 | 1/1941 | Pier et al. | 208/10 |
| 3,162,594 | 12/1964 | Gorin | 208/57 |
| 3,188,179 | 6/1965 | Gorin | 23/212 |
| 3,232,861 | 2/1966 | Gorin et al. | 208/8 |
| 3,488,279 | 1/1970 | Schulman | 206/10 |
| 3,527,691 | 9/1970 | Hodgson | 208/10 |
| 3,549,512 | 12/1970 | Hodgson | 208/10 |
| 4,159,238 | 6/1979 | Schmid | 208/10 |
| 4,189,372 | 2/1980 | Baldwin et al. | 208/8 |
| 4,196,072 | 4/1980 | Aldridge et al. | 208/10 |
| 4,255,248 | 3/1981 | Rosenthal et al. | 208/8 LE |
| 4,295,954 | 10/1981 | Mitchell | 208/10 |
| 4,338,183 | 7/1982 | Gatsis | 208/10 |
| 4,344,838 | 8/1982 | Mitchell | 208/10 |
| 4,379,744 | 4/1983 | Rosenthal et al. | 208/10 |

*Primary Examiner*—Patrick Garvin
*Assistant Examiner*—Lance Johnson
*Attorney, Agent, or Firm*—Geoffrey L. Chase; E. Eugene Innis; James C. Simmons

[57] ABSTRACT

A process is set forth for the integrated liquefaction of coal by the catalytic solvent refining of a feed coal in a first stage to liquid and solid products and the catalytic hydrogenation of the solid product in a second stage to produce additional liquid product. A fresh inexpensive, throw-away catalyst is utilized in the second stage hydrogenation of the solid product and this catalyst is recovered and recycled for catalyst duty in the solvent refining stage without any activation steps performed on the used catalyst prior to its use in the solvent refining of feed coal.

7 Claims, 1 Drawing Figure

INTEGRATED PROCESS FOR THE SOLVENT REFINING OF COAL

The Government of the United States of America has rights in this invention pursuant to contract number DE-AC22-79ET14806 awarded by the U.S. Department of Energy.

TECHNICAL FIELD

The present invention is directed to the field of solvent refining or liquefaction of coal. More specifically, the present invention is directed to the solvent refining of coal to produce liquid and normally solid products wherein the normally solid products are further catalytically processed to provide additional liquid product. The invention contemplates the recycle of catalyst from the processing of the normally solid product to the solvent refining of coal.

BACKGROUND OF THE PRIOR ART

With the reduction in availability of traditional petroleum sources for liquid fuels, increased activity has occurred in the processing of solid fuel sources such as various rankings of coal. Attempts have been made to provide a commercially attractive process for the production of liquid fuels which are economically competitive with the remaining petroleum fuels which are still currently available. Traditionally, coal liquefaction has been performed at exceedingly high pressures and with the need for large quantities of expensive hydrogen. Additionally, in order to produce improved yields of liquid product from coal, expensive metal catalysts of the molybdenum, cobalt and nickel type in various physical forms have been utilized. All of these aspects of the previous attempts to provide commercially viable liquid fuels from coal have significantly affected the costs of producing such fuels.

Subsequently, attempts have been made to reduce the processing costs for the liquefaction of coal to liquid fuels. Generally, liquefaction pressures have been reduced from the 5,000 to 10,000 psi processing range to a range of 2,000 psi or less. Catalysts for the coal liquefaction have also been chosen for their lack of initial expense, as well as their selective activity for the liquefaction reactions.

In this light, U.S. Pat. No. 3,162,594 discloses the use of an inexpensive disposable catalyst, such as red mud, in hydrogenating coal extract. The spent catalyst from a coal extract hydrogenator is recovered by conventional solid/liquid separation and is recycled to a coal extract hydrogenator either without any treatment or after regeneration. Furthermore, U.S. Pat. No. 3,162,594 discloses the recycling of a spent supported catalyst from a downstream hydrocracker, after crushing, to a coal extract hydrogenation zone. Coal extract is the material obtained by the solvent extraction of coal after being separated from the mineral matter and the undissolved coal. It contains a minute, unfilterable amount of metallic contaminants, commonly referred to as ash. This recycle concept has been used not only for catalysts, but also for the solvent for a coal liquefaction reaction as taught in U.S. Pat. No. 3,188,179.

Recycling spent catalysts diminishes the catalyst expense, but involves a reduction in catalyst activity. Various techniques have been utilized to improve recycle catalyst activity, and exemplary of such techniques is U.S. Pat. No. 3,232,861 in which a supported catalyst from a coal extract hydrocracker is ground to expose previously unexposed internal surface area of the catalyst and to renew its activity before reintroducing the catalyst into a coal extract hydrotreater.

U.S. Pat. No. 3,488,279 discloses the recycle of a supported catalyst from a liquid coal product hydrocracker to a catalytic hydrogenation zone to hydrotreat coal extract before feeding it to a hydrocracker.

The recycle of catalyst in a coal liquefaction process is further described in U.S. Pat. Nos. 3,527,691 and 3,549,512 wherein the process is practiced in the absence of any substantial liquid phase and the catalyst functions as an adsorbent for the product of the coal conversion.

In U.S. Pat. No. 4,159,238, a coal liquefaction mineral residue and solid SRC are recycled from a downstream separator tower back to the coal liquefaction reactor.

U.S. Pat. No. 4,189,372 discloses the recycle of solvent from a coal extract hydrocracker back to the coal liquefier vessel.

The use of spent hydrotreating catalysts from the hydrogenation of petroleum, petroleum-derived liquids, Fischer-Tropsch liquids and shale oil hydrocarbon processes to a coal liquefaction process is described in U.S. Pat. No. 4,295,954. The recycled catalysts are taught to be selected from those catalysts used for the hydrogenation of high quality hydrocarbons.

Metal compounds such as oxides and sulfides of elements from Groups VI and VII of the Periodic Table are known to be good hydrogenation catalysts. Silica and alumina alone are also known to be good cracking catalysts in petroleum refining industry because of their acidity. It is also known that when metals from Group VI and VIII are deposited on either silica or alumina or both, they produce good hydrocracking catalysts.

The activity of any hydrocracking catalyst depends greatly on the metal loading, surface area and pore volume of the catalyst. If ash is not removed from coal extract prior to catalytic hydrocracking using a supported catalyst, the ash tends to deposit on the catalyst causing a reduction in surface area, as well as a reduction in the pore volume of the catalyst and eventually catalyst deactivation.

Coal extract is not similar to, nor does it behave similarly to other hydrocarbon materials, such as petroleum derived material, primarily because coal extract has a significantly different chemical structure from that of other hydrocarbon materials. Coal extract is solid at room temperature, whereas the petroleum-derived materials are liquid. Coal extract is rich in asphaltenes and preasphaltenes (high molecular weight compounds having low hydrogen content), while other hydrocarbonaceous materials contain small amounts of asphaltenes and do not contain preasphaltenes at all. In comparison with petroleum fuels and residue, coal liquids generally exhibit slightly higher carbon content, but significantly lower hydrogen content. The coal liquids have a higher degree of aromaticity and a more highly condensed ring structure than petroleum. A more striking difference between the coal liquids and petroleum fuels is the heteroatom content. Nitrogen and oxygen in coal liquids are much higher than in petroleum, but sulfur is somewhat lower. Coal extract ash is not similar nor does it behave similarly to ash contained in petroleum and other materials. The metallic contaminants, i.e., ash contained in petroleum derived liquids generally are associated with a porphyrin type of molecule which is to a large extent soluble in the petroleum. In contrast, up to 50 wt% of the metallic contaminants in coal extract are insoluble and finely divided particles. The metals in coal extract include Na, Si, Fe, Ca, Mg, Al, Ti, and Boron. The petroleum derived material contain predominantly Ni, Ti, and Vanadium.

It is known that coal extract readily undergoes degradation when it is subjected to thermal treatment. The degradation is manifested by the formation of coke, hydrocarbon gases and by the increase in the high molecular weight, hydrogen deficient portion of the extract. The benzene-insoluble (preasphaltene) content of the extract is a measure of this undesirable, high molecular weight extract portion.

The finely divided ash present in the coal extract can diffuse through the fine pore structure of a supported catalyst and deposit thereon during hydrocracking. This significantly reduces the surface area and pore volume of the catalyst. Metal deposition coupled with coke deposition drastically reduces the activity of the supported catalyst. Such decrease in activity forces resort to more frequent replenishment of the catalyst with fresh catalyst.

The prior art has made many attempts to provide an economic process for the liquefaction of coal to liquid fuel products. However, the full utilization of inexpensive catalyst material in a process for the production of liquid fuels from coal wherein the liquid fuels produced constitute a predominent portion of the product of the process has not been taught in the prior art. Such an advantage is realized in the process of the present invention as described below.

BRIEF SUMMARY OF THE INVENTION

The present invention contemplates a process for the solvent refining of coal to produce liquid and solid products with the subsequent upgrading of the normally solid coal product in a hydrogenation zone in the presence of a hydrogenation catalyst which catalyst comprises an inexpensive, throw-away catalyst which is unsupported. The hydrogenation catalyst, after duty in the hydrogenation of normally solid solvent refined coal product, is separated from the hydrogenation product and recycled to the initial coal processing stage wherein solvent refining of fresh coal is conducted in the presence of this used hydrogenation catalyst. The process produces additional quantities of liquid fuel product from the solid, fresh coal feed, while utilizing only a single inexpensive catalyst for both post-hydrogenation of solvent refined coal and initial solvent refining of fresh coal feed.

The catalyst of the present invention is added to normally solid, previously solvent refined coal product along with a solvent and hydrogen before being introduced into a hydrogenation zone for the production of additional liquid from the solvent refined coal. Distillable liquid product is separated from the residual coal product and catalyst preferably by distillation. A portion of the liquid product can be recycled as the solvent for the hydrogenation treatment. Unconverted solvent refined coal is separated from the used catalyst either by centrifugation or filtration. The centrifugation or filtration step also aids in removing some of the finely divided ash from the unconverted solvent refined coal. The recovered solvent refined coal can be further treated in a catalytic hydrocracker to produce additional distillable liquids. The used catalyst is recycled without further activation treatment to the initial process stage of the coal liquefaction for the solvent refinement of fresh coal. It is utilized as a catalyst along with solvent to convert fresh coal feed into a liquid product and a normally solid solvent refined coal product. Again, a portion of the liquid product can be recycled as solvent for the solvent refining stage. The normally solid coal product from the initial solvent refining stage is separated from the spent catalyst from said stage as well as from the ash, unconverted coal and mineral matter derived from the feed coal. The remaining normally solid solvent refined coal is then slurried with solvent and fresh hydrogenation catalyst before being introduced into the hydrogenation stage of the process, as described above.

This cyclic utilization of the hydrogenation catalyst allows for the production of additional quantities of liquid product from a set amount of solid coal feed without incurring additional expense for the catalysis of the initial solvent refining stage of the overall process.

It has been unexpectedly discovered that the hydrogenation catalyst from a solvent refined coal hydrogenation upgrading reaction, in which the catalyst experiences the severe environment of the metals and crude components of coal, is still significantly active without treatment to catalyze the initial solvent refining stage of a coal liquefaction process in order to allow the recycle and combined use of the catalyst for not only hydrogenation of solvent refined coal, but also the initial solvent refining of fresh coal.

DETAILED DESCRIPTION OF THE INVENTION

Figure 1:
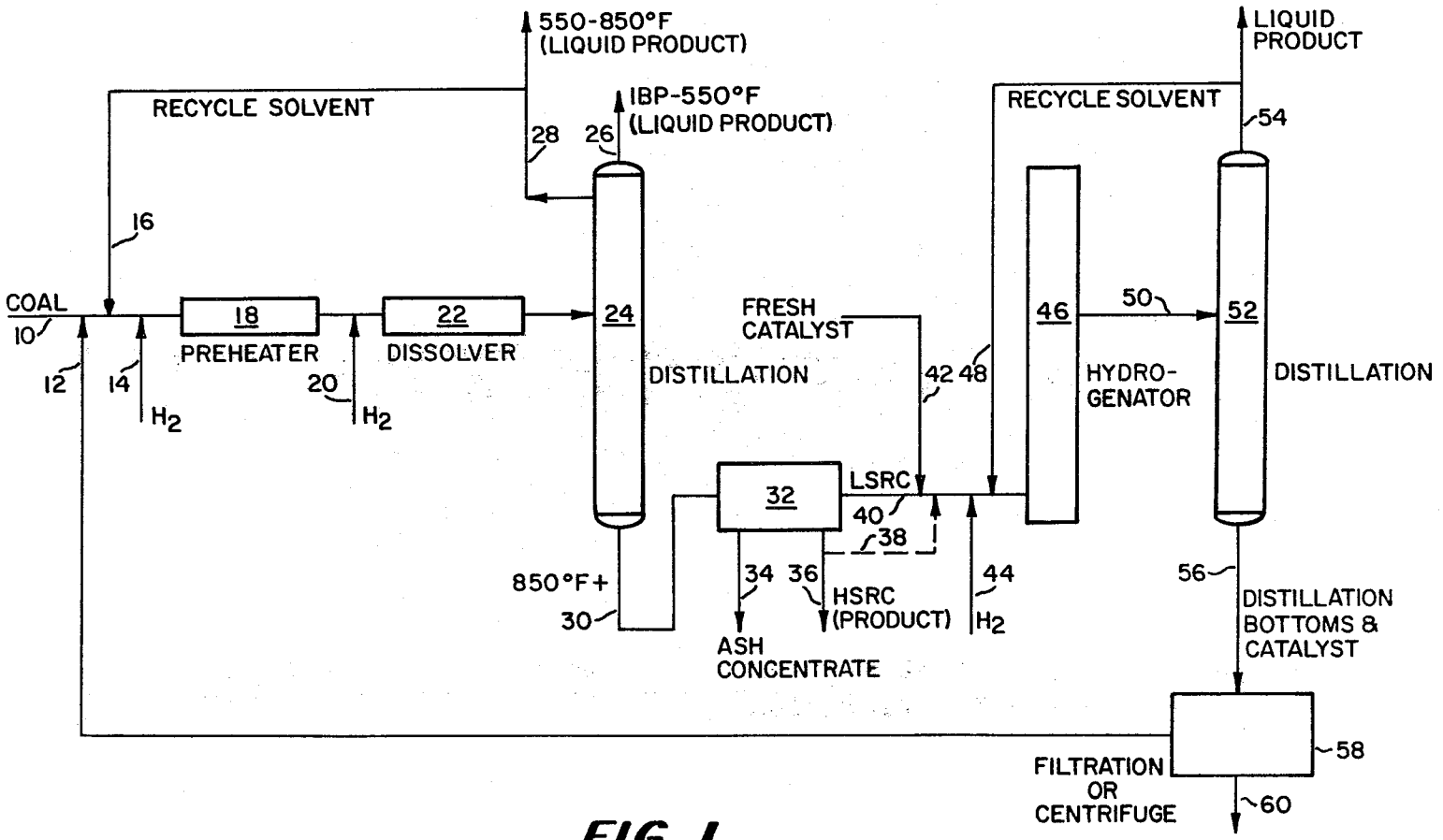
FIG. 1 shows a basic flow scheme for the process of the subject invention.

Coal liquefaction can be performed in a number of processes. However, the coal liquefaction process which is contemplated by the present invention is where coal is reacted in the presence of a solvent, particularly a hydrogen-donor solvent, in order to convert the solid coal to liquid products and a normally solid, solvent refined coal product. The present invention subsequently contemplates the treatment of the normally solid, solvent refined coal with a fresh hydrogenation catalyst in a hydrogenation environment, which is not as severe as a hydrocracking environment, wherein the solvent refined coal is further treated to extract additional liquid product values and a residual solid product.

The present invention is a method for producing liquid fuels from coal at a lower processing cost. By recycling the used catalyst from the coal extract hydrogenation stage of the method to the fresh coal solvent refining or liquefaction zone, the method economizes on catalyst requirements. This is a significant cost reduction because of the more severe environment catalysts must experience in coal liquefaction and coal extract hydrogenation in comparison to comparable petroleum upgrading processes wherein catalysts are utilized.

The recycling of supported hydrocracking catalysts has been attempted as discussed above. The major obstacle of that recycling attempt has been the need to re-activate the hydrocracker catalyst usually by grinding or abrading to expose new catalyst surface areas. Hydrocracker catalyst is dependent on surface area and pore size to provide catalytic activity. Therefore, that type of catalyst is highly susceptible to coke fouling and metal fouling, both of which are heightened in coal processing.

The extent of fouling of a supported hydrocracker catalyst used in solvent refined coal processing is apparent from a comparison of the catalyst before and after use. A typical analysis of a fresh and a deactivated nickel-molybdenum supported on alumina catalyst obtained from hydrocracking of solvent refined coal is given below.

TABLE 1

| | CATALYST (wt %) | |
|---|---|---|
| | Fresh | Deactivated |
| carbon | — | 18.4 |
| sulfur | — | 6.3 |
| Fe | — | 0.2 |
| Ti | — | 0.3 |
| Ca | — | 0.1 |
| Na | — | 4.2 |
| Surface Area $m^2/g$ | 152 | 89 |
| Pore Diameter A | 96 | 49 |
| Pore Volume ml/g | 0.38 | 0.14 |

The coke and metal deposition on the catalyst is high, but more important to hydrocracker catalyst, the surface area, the pore diameter, and the pore volume, which are very critical to the performance of such a catalyst, decreased significantly.

In relatively clean hydrocarbon processing systems, such as Fischer-Tropsch, the catalyst deactivation is primarily due to coke formation (up to 50%) and the activity of the catalyst is regenerated to a large extent by burning off the carbon. Similarly, catalyst deactivation in a petroleum refining operation is due to coke formation because there are no ash or metals in the feed. The catalyst normally has a long life. Deactivation of hydrocracking catalyst in resid hydroprocessing is the result of coking as well as metal deposition. Still, such catalyst deactivation is not as severe as in the hydrocracking of solvent refined coal.

The problem of supported catalyst deactivation can be greatly reduced by hydrogenating coal extract, before hydrocracking the extract, in which the hydrogenation is performed with finely divided metal compounds as a slurry catalyst, as in the present invention. Since this type of catalyst is non-porous, the ash and metals present in the coal extract do not deposit on the catalyst and the activity is maintained for a longer period of use than with supported catalysts.

The reaction severity of hydrocracking operations is also distinctly different than that of hydrogenation operations. Hydrocracking usually effects the removal of heteroatoms from the hydrocarbon stock being processed, as well as successfully breaking and hydrogenating complex aromatic structures. On the other hand, hydrogenation is effective for hydrogenating large molecular weight aromatic compounds and reducing their molecular size, but is not sufficiently severe to significantly effect heteroatom removal or the cracking of aromatic hydrocarbons. The formation of hydrocarbon and heteroatom gases, therefore, is much lower in hydrogenation reactions than in hydrocracking reactions.

The process of the present invention is best understood and is easily demonstrated by reference to FIG. 1 wherein a preferred embodiment of the present invention is set forth. A particulate coal feed material, such as bituminous coal or lignite is introduced into the system through line 10. The particulate coal is mixed with a recycled hydrogenation catalyst, such as an inexpensive pyrite and residual solvent refined coal introduced in line 12 from a downstream portion of the process. Other suitable catalysts include any of the known hydrogenation catalysts, such as the oxides and sulfides of transition metals, particularly Group VIII and VIB. Typical catalysts include metals from Groups IVB, VB, VIB, VIIB and VIII. The metals can be used individually or in various combinations as taught in U.S. Pat. No. 2,227,672 incorporated herein by reference. Preferably, metals as their oxides and sulfides are utilized. The catalyst can be in the form of water-soluble or organic compound (thermally unstable) soluble salts, which are either emulsified or mixed in the process solvent. Oil-soluble metal compound catalysts can also be used. Suitable oil-soluble catalysts include: (1) inorganic metal halides, oxyhalides and heteropoly acids, (2) metal salts of organic acids, such as acyclic, alicyclic-aliphatic organic acids, (3) organometallic compounds and (4) metal salts of organic amines. Particulate catalysts can also be used, such as pyrite, iron oxide, red mud, low concentration of metals, such as molybdenum and their compounds and combinations. However, the important attribute of the present invention is that the hydrogenation catalyst has an extremely small particle size, preferably less than 200 mesh, and that its activity is not dependant on pore attributes or surface area of catalyst particles individually, as is the case with hydrocracker catalysts.

The mixture of catalyst and particulate coal is slurried in a coal solvent, such as creosote oil, tetralin, naphthalene or other coal or petroleum produced solvent, such solvent being introduced through line 16. Hydrogen is added through line 14 at a pressure in the range of 500 psia to 10,000 psia. The coal-solvent slurry is then heated to an elevated temperature in the preheater 18. The temperature is generally in the range of 400° F. to 780° F. The heated slurry is then combined with additional hydrogen from line 20. This hydrogen is also supplied at a pressure range of 500 psia to 10,000 psia. The heated slurry is then introduced into the dissolver 22 wherein the liquefaction and solvent refining of the particulate coal material is performed in a catalytic manner in the presence of the used and recycled hydrogenation catalyst. The temperature in the dissolver is generally maintained in the range of 780° F. to 900° F., while the pressure is maintained in the range of 500 psia to 10,000 psia and a hydrogen feed rate of 5–50 s.c.f./lb of feed coal.

After a residence time in the dissolver 22 which is generally from 5 minutes to 100 minutes, the products of the solvent refining of the coal are removed for separation and recovery. The product gases are separated from the liquefied coal slurry in a gas/liquid separator, not shown in FIG. 1. The slurry is then fractionated into various fractions. Preferably, this separation is performed in a distillation column 24. A light liquid product including some gases is removed as an overhead stream in line 26 from the distillation column. this product stream includes initial boiling point hydrocarbons up to hydrocarbons boiling at 550° F. An intermediate cut of hydrocarbon is removed from the mid-portion of the distillation column in line 28 and constitutes a liquid hydrocarbon fraction in the range of 550° to 850° F. boiling point materials. A portion of this product is recycled 16 as a process solvent for the feed slurry which is fed to the preheater 18 and dissolver 22.

Not all of the coal feed material is converted to distillable liquid in the solvent refining process which is performed in the dissolver 22. A portion of the coal remains in the solid phase at room temperature although it is fluid at the reaction temperature used in the solvent refining process. Despite this product being normally solid at room temperature, it is significantly more refined than the initial coal material and is referred to as solvent refined coal (SRC). This normally solid solvent refined coal, along with spent catalyst and unconverted coal and coal mineral matter is removed in line 30 from the base of the distillation column 24. This material is generally catagorized as having a boiling point in the range of 850° F. and above.

The solvent refined coal mixture in line 30 is introduced into a separation unit 32, wherein various fractions of the solvent refined coal mixture are isolated, preferably by a critical solvent deashing method. In this manner, ash, unreacted coal, mineral matter and spent catalyst are removed in line 34 either for disposal or for the production of hydrogen by partial oxidation. A heavy solvent refined coal (HSRC) is removed from the separation unit 32 in line 36 as a solid product. HSRC is a solid solvent refined coal having a high benzene insolubles content normally comprising a significant level of preasphaltenes. The final fraction which is removed in the separation unit 32 is a light solvent refined coal (LSRC), which is removed in line 40. LSRC comprises a solid refined coal material which is high in benzene solubles, which are normally referred to as asphaltenes. This fraction is desirably further processed for the production of additional distillable liquid fuel recovery. Alternately, some portion of the HSRC fraction may also be further processed with the LSRC. The HSRC would be supplied through line 38.

The solvent refined coal in line 40, now free of unconverted coal, mineral matter, spent catalyst and ash, is then mixed with fresh catalyst from line 42. This catalyst is preferably an inexpensive, throw-away catalyst such as iron oxide, pyrite or one of the previously mentioned catalysts. The catalyst would be an unsupported catalyst in order to avoid the costs and deactivation susceptability of such catalysts when used in a once-through manner as the present catalyst will be used. The catalyst and solvent refined coal mixture in line 40 is slurried with a solvent from line 48. The solvent can be similar to the solvent previously supplied to the process in line 16 or it can be recovered from the downstream distillation unit or generated in the downstream hydrocracking reactor. Again, hydrogen in line 44 is supplied to the slurried mixture and the composite slurry is introduced into a hydrotreating unit 46. The conditions in the hydrogenation reactor 46 are as follows: 750°-900° F., 500-10,000 psig, a hydrogen feed rate in the range of 5-50 s.c.f./lb of feed and a residence time of 20 minutes to 10 hours. The hydrogenation reactor differs from hydrocracking operations in that the severity of the reaction in hydrogenation is much less than in hydrocracking. The extent of conversion to distillable material and gases in hydrogenation is considerably lower than in hydrocracking. In addition to the severity of the reaction, the catalysts employed in hydrogenation and hydrocracking reactions are distinctly different. Metals of Groups VI and VIII are known to be good hydrogenation catalysts, but have very little cracking activity. In order to have good cracking activity, these metals are combined with silica or alumina or both. This combination thus produces a good hydrocracking catalyst.

The product from the hydrogenation reactor 46 is removed in line 50 and treated in a gas/liquid separator not shown in FIG. 1 to remove hydrocarbon and other gases. The liquid product is then transported for separation into distillable and non-distillable products. Preferably, this separation is performed in a distillation column 52. Liquid products are removed from the overhead of the distillation column in line 54. A portion of the liquid product can be recycled in line 48 as solvent for the hydrogenation performed in the hydrogenation reactor 46. The composite non-distillable product is referred to as distillation bottoms. The used hydrogenation catalyst which would normally be considered to be inactive or reduced in activity below a practical level, especially in treating a coal feedstock, is separated by filtration or centrifuge 58 from the unconverted solvent refined coal and is then recycled in line 12 to the front end of the process to be mixed with particulate feed coal and slurried with solvent as the influent to the preheater and dissolver 18 and 22, respectively. The centrifugation or filtration step also aids in removing some of the finely divided ash from the unconverted solvent refined coal. The separated unconverted solvent refined coal material from the filtration or centrifuge device 58 is removed in line 60 for further treatment, such as in a hydrocracker. In this manner, the hydrogenation catalyst added in line 42 for the hydrogenation reactor 46 is subsequently utilized in the dissolver 22 for the catalytic solvent refining of feed coal, before the catalyst, having been twice used in a catalytic manner, is removed as spent catalyst from the solvent separation unit 32 in line 34 along with the ash and mineral matter separated from the liquefied coal slurry.

The following examples demonstrate the manner in which the various stages of the process of the present invention are performed, but also the marked increase in product conversion in comparison to the prior art.

EXAMPLE 1

This example illustrates the hydrogenation of LSRC in the absence of a catalyst. A 5 g sample of process solvent having elemental composition shown in Table 2 and 5 g LSRC having the elemental composition shown in Table 3, were charged to a tubing-bomb reactor having a volume of 46.3 ml. The reactor was sealed, pressurized with hydrogen to 1250 psig at room temperature and heated to 425° C. It was maintained at the reaction temperature for 60 minutes and then cooled to room temperature. The reaction product was analyzed to give a product distribution as shown in Table 4. SRC conversion due to this thermal reaction was only 13.1 wt%. Conversion is the transformation of SRC to oils and gases.

EXAMPLE 2

This example illustrates the hydrogenation of LSRC in the presence of a pyrite catalyst. The process solvent, and LSRC mixture described in Example 1 was mixed with 1 g of pyrite and reacted in the tubing-bomb reactor at the same reaction conditions described in Example 1. The reaction product distribution obtained is shown in Table 4. The conversion of SRC to distillate oil was significantly higher than shown in Example 1. The production of gases was lower than shown in Example 1. Most of the preasphaltene present in LSRC was converted to oil and gases.

EXAMPLE 3

This example illustrates the hydrocracking of LSRC in the presence of a commercial Co-Mo hydrocracking catalyst supported on alumina. The reaction mixture described in Example 1 was mixed with 1 g Co-Mo-Al and reacted in the tubing-bomb reactor at the same reaction conditions described in Example 1. The reaction product distribution obtained is again shown in Table 4. The conversion of SRC to oil was higher than shown in Examples 1 and 2. The production of gases was comparable to that shown in Example 1, but was higher than Example 2. Most of the preasphaltene present in LSRC was converted to oil and gases. The higher gas and oil production in this example in comparison to Example 2 demonstrates the difference in severity between hydrogenation and hydrocracking reactions.

TABLE 2

Analysis of the Process Solvent

| | Weight % |
|---|---|
| Fraction | |
| Oil | 92.8 |
| Asphaltene | 5.8 |
| Preasphaltene | 0.7 |
| Residue | 0.7 |
| Element | |
| Carbon | 89.44 |
| Hydrogen | 7.21 |
| Oxygen | 1.70 |
| Nitrogen | 1.10 |
| Sulfur | 0.55 |

TABLE 3

Analysis of the LSRC Sample

| Fraction | Weight % |
|---|---|
| Oil | 12.0 |
| SRC | 85.8 |
| Asphaltene | 71.4 |
| Preasphaltene | 14.4 |
| Residue | 2.2 |
| C | 85.4 |
| H | 6.8 |
| O | 4.3 |
| N | 1.7 |
| S | 1.0 |

TABLE 4

Conversion and Product Distribution of LSRC

| | Example 1 | Example 2 | Example 3 |
|---|---|---|---|
| Catalyst | None | Pyrite | Co—Mo—Al |
| Gases | 4.6 | 2.7 | 4.7 |
| Oil | 18.5 | 41.4 | 72.5 |
| SRC | 74.6 | 55.9 | 21.0 |
| Asphaltene | 65.4 | 55.1 | 20.8 |
| Preasphaltene | 9.2 | 0.8 | 0.2 |
| Residue | 2.2 | 0.0 | 1.8 |
| SRC Conversion | 13.1 | 34.9 | 75.5 |

EXAMPLE 4

This example illustrates the hydrogenation of HSRC in the absence of a catalyst. A 1.2 g sample of process solvent having elemental composition shown in Table 5 and 2.8 g HSRC having the elemental composition shown in Table 5, were charged to a tubing-bomb reactor having a volume of 50 ml. The reactor was sealed, pressurized with hydrogen to 850 psig at room temperature and heated to 806° F. It was maintained at the reaction temperature for 2 hours and then cooled to room temperature. The reaction product was analyzed to give a product distribution as shown in Table 6. HSRC conversion due to this thermal reaction was 22.8%.

EXAMPLE 5

This example illustrates the hydrogenation of HSRC in the presence of a molybdenum catalyst. The process solvent and HSRC mixture described in Example 4 was mixed with 500 ppm molybdenum (as molybdenum octoate) by wt. of HSRC and reacted in the tubing-bomb reactor at the same reaction conditions described in Example 4. The reaction product distribution obtained is shown in Table 6. The conversion of SRC to distillate oil was significantly higher than shown in Example 4. The production of gases was lower than shown in Example 4.

EXAMPLE 6

This example illustrates the hydrocracking of HSRC in the presence of a commercial hydrocracking Ni-Mo catalyst supported on alumina. A mixture of HSRC and process solvent having a similar composition as used in Examples 4 and 5 was hydrocracked in a continuously stirred first basket catalytic reactor. The reaction conditions were as follows: 800° F. temperature, 2,000 psig pressure, WHSV=1.0 $hr^{-1}$ (g feed/g cat. hr.), LHSV=0.1 $hr^{-1}$ (ml feed/ml reactor hr), and a hydrogen flow rate of 16 s.c.f./lb of feed. The reaction product distribution obtained is shown in Table 6. The data actually represent the initial activity of the catalyst which generally drops drastically with time on stream. The production of oil was higher than Example 4. Significantly higher production of gases in Example 6 than Examples 4 and 5 clearly shows the hydrocracking activity and higher heteroatom removal activity of the hydrocracking catalyst.

TABLE 5

Analysis of HSRC and Process Solvent

| | Weight % | |
|---|---|---|
| | HSRC | Process Solvent |
| Fraction | | |
| Oil | 6.0 | 100.0 |
| SRC | 94.0 | 0.0 |
| Element | | |
| Carbon | 86.9 | 89.3 |
| Hydrogen | 6.0 | 9.7 |
| Oxygen | 4.1 | 0.5 |
| Nitrogen | 2.0 | 0.5 |
| Sulfur | 1.0 | 0.1 |

TABLE 6

Conversion and Product Distribution of HSRC

| | Example 4 | Example 5 | Example 6 |
|---|---|---|---|
| Catalyst | None | Molybdenum | Ni—Co—Al |
| Gases | 6.8 | 6.4 | 18.3 |
| Oil | 15.9 | 58.7 | 60.9 |
| SRC | 77.3 | 34.9 | 20.9 |
| SRC Conversion | 22.7 | 65.1 | 79.1 |

EXAMPLE 7

This example illustrates the hydrogenation of a process solvent in the absence of a catalyst. The elemental composition and boiling point distribution of the process solvent are shown in Tables 7 and 8, respectively. The process solvent was passed into a one-liter continuous stirred tank reactor at a total pressure of 2000 psig and a hydrogen flow rate of 2.2 wt% solvent. The reaction temperature was 850° F. and the nominal residence time was 61 minutes. The reaction product distribution obtained is shown in Table 9. The concentrations of oil and asphaltene were lower compared to untreated original solvent as shown in Table 9. The concentration of preasphaltene was higher than that in original solvent. There was a net production of hydrogen by hydrotreating process solvent alone. These data indicate that the process solvent was dehydrogenated when treated alone.

EXAMPLE 8

This example illustrates the catalytic activity of pyrite in hydrogenation of a process solvent. The process solvent described in Example 7 was processed at the same reaction conditions as described in Example 7. The pyrite was obtained from the Robena Mine at Angelica, Pa. The chemical composition of pyrite is given in Table 10. The pyrite was added at a concentration level of 10.0 wt% of slurry. The product distribution obtained is shown in Table 9. The concentration of oil with pyrite was higher than both shown in Example 7 and present in the original solvent. A major portion of asphaltene was converted to oil and hydrocarbon gases with pyrite which indicates its hydrogenation activity. The hydrogen consumption was 0.5 wt% of solvent. X-ray diffraction analysis of the solid residue obtained by solvent hydrogenation reaction with pyrite showed complete conversion of pyrite to pyrrhotite 11C, which is $FeS_{1.099}$.

EXAMPLE 9

This example illustrates the reaction of coal without a catalyst. A 3 g sample of Kentucky Elkhorn #3 coal having the composition shown in Table 11 was charged to a tubing-bomb reactor having a volume of 46.3 ml. A 6 g quantity of solvent described in Example 7 was then added to the reactor. The reactor was sealed, pressurized with hydrogen to 1250 psig at room temperature and heated to 450° F. for 60 minutes. The reactor was then cooled and the reaction product was analyzed to give a product distribution as shown in Table 12. Conversion of coal was 77% and the oil yield was 16% of maf coal.

EXAMPLE 10

This example illustrates the activity of the used catalyst recovered from the solvent hydrogenation reaction (Example 8) in a coal liquefaction reaction. To the reactor described in Example 9 was added 3 g of coal described in Example 9 and 6 g of solvent described in Example 7. Two different amounts (0.25 g and 1.0 g) of used catalyst (Pyrrhotite, $FeS_{1.099}$) recovered from Example 8 were added to the coal-solvent reaction mixture. The reaction and product analysis were carried out in the same way as described in Example 9. The conversion of coal and oil production shown in Table 12 were significantly higher when either 0.25 g or 1.0 g of spent catalyst were used than shown in Example 9.

TABLE 7

| Elemental Composition of Solvent | |
|---|---|
| | Weight % |
| Element | |
| Carbon | 88.79 |
| Hydrogen | 7.40 |

TABLE 7-continued

| Elemental Composition of Solvent | |
|---|---|
| | Weight % |
| Oxygen | 1.96 |
| Nitrogen | 1.20 |
| Sulfur | 0.48 |
| | 99.83 |
| Molecular Weight | 210 |
| NMR Distribution of Hydrogen, % | |
| $H_{Aromatic}$ | 42.0 |
| $H_{Benzylic}$ | 29.3 |
| $H_{Other}$ | 28.7 |

TABLE 8

| Simulated Distillation of Solvent | |
|---|---|
| Weight % Off | Temperature °F. |
| I.B.P. | 513 |
| 5% | 536 |
| 10% | 547 |
| 11% | 550 |
| 20% | 576 |
| 30% | 597 |
| 40% | 615 |
| 50% | 638 |
| 60% | 663 |
| 70% | 690 |
| 80% | 721 |
| 90% | 773 |
| 95% | 820 |
| 97% | 850 |
| 99% | 900 |
| F.B.P. | 921 |

TABLE 9

| Hydrogenation of Process Solvent | | | |
|---|---|---|---|
| | Original Process Solvent | Example 7 | Example 8 |
| Feed Composition | — | 100% Solvent | 90% Solvent + 10% Pyrite |
| Temp., °F. | — | 850 | 850 |
| Pressure, psig | — | 2000 | 2000 |
| Hydrogen Flow Rate, Wt % Solvent | — | 2.2 | 2.0 |
| Reaction Time, Min. | — | 61 | 60 |
| Product Distribution, Wt % | | | |
| HC | — | 0.9 | 1.8 |
| CO, $CO_2$ | — | 0.3 | 0.2 |
| $H_2S$ | — | 0.2 | 0.2 |
| $NH_3$ | — | 0.0 | 0.4 |
| Oil | 90.8 | 87.3 | 92.9 |
| Asphaltene | 8.9 | 7.6 | 3.2 |
| Preasphaltene | 0.4 | 3.3 | 0.7 |
| I.O.M. | 0.0 | 0.2 | 0.0 |
| Water | — | 0.1 | 0.8 |
| Hydrogen Consumption, Wt % Solvent | — | −0.2 | 0.5 |

TABLE 10

| Analysis of Robena Pyrite | |
|---|---|
| | Weight % |
| C | 4.5 |
| H | 0.3 |
| N | 0.6 |
| S | 41.3 |
| O | 6.0 |
| Fe | 42.3 |
| Sulfur Distribution | |
| Pyritic | 40.4 |
| Sulfate | 0.7 |

TABLE 10-continued

| Analysis of Robena Pyrite | Weight % |
|---|---|
| Organic | 0.6 |

Other Impurities — Al, Si, Na, Mn, V, Ti, Cr, Sr, Pb, Co, Mg, Mo, Cu and Ni

TABLE 11

| Analysis of Elkhorn #3 Coal Obtained From Floyd County, Kentucky | Weight % |
|---|---|
| Proximate Analysis | |
| Moisture | 1.81 |
| Volatile | 37.56 |
| Fixed Carbon | 46.03 |
| Dry Ash | 14.60 |
| Ultimate Analysis | |
| C | 69.40 |
| H | 4.88 |
| N | 1.00 |
| S | 1.94 |
| O (by difference) | 8.18 |
| Distribution of Sulfur | |
| Total Sulfur | 1.94 |
| Sulfate Sulfur | 0.04 |
| Pyrite Sulfur | 1.19 |
| Organic Sulfur | 0.75 |

TABLE 12

| Conversion and Product Distribution Based on MAF Coal | Example 9 | Example 10 | |
|---|---|---|---|
| Catalyst | None | Pyrrhotite, | $FeS_{1.099}$ |
| Amount of Catalyst, g | — | 0.25 | 1.0 |
| Oil | 16 | 42 | 41 |
| Asphaltene | 48 | 33 | 40 |
| Preasphaltene | 13 | 13 | 9 |
| I.O.M. | 23 | 12 | 10 |
| Conversion | 77 | 88 | 90 |

The hydrogenation of coal process solvent is deemed to be a representative model of the catalyst duty that would be experienced by the catalyst of the present invention in the hydrogenation of normally solid solvent refined coal, such as takes place in the hydrogenator 46. The examples show that catalyst, including inexpensive, relatively low activity catalysts such as pyrite, maintain sufficient activity after catalytic duty in hydrogenating coal process solvent to still provide a significant level of catalytic affect to the solvent refining of feed coal, as is demonstrated in a comparison of Example 9 and Example 10, recited above. In those examples, the catalytic affect of the previously used hydrogenation catalyst, pyrite (converted in situ to pyrrhotite), is easily discerned from the conversion ratios listed in Table 12. Particularly, the oil value, which is one of the most important product components which is sought from the solvent refining or conversion of coal feedstocks, is remarkably increased from the non-catalytic Example 9, in which only 16% oil is produced, to the catalytic runs in Example 10 wherein the oil component is 42% and 41%, respectively. It is also demonstrated in a comparison of the results of Example 9 and Example 10 in Table 12 that the overall conversion is also significantly affected by the previously used catalyst in terms of the conversion of the feed coal material in those examples. Example 9 has a 77% conversion, while the several runs of Example 10 in which used catalyst was present have a conversion of 88% and 90%, respectively.

This demonstrated activity of the catalyst shows that it is economically feasible to utilize an inexpensive, throw-away hydrogenation catalyst, which has less overall activity than the expensive metal supported hydrocracking catalysts, for the hydrogenation of the solid products from a solvent refining of coal and, in addition, recycling this used catalyst for significant catalytic activity in the initial solvent refining stage of a coal processing system, as set forth in the present invention. This provides not only economic operation, but conservation of resources in that less catalyst is necessary to perform the overall processing of coal feedstocks.

The present invention has been demonstrated in a particular preferred embodiment, but it is deemed to be within the skill of those in the art to vary specific details of the overall process and such details are deemed to be contemplated by the present process. Therefore, the scope of the present invention should not be limited to this preferred embodiment, but rather should be ascertained by the claims which follow.

I claim:

1. A process for the catalytic solvent refining of coal into liquid and solid products with the subsequent catalytic hydrogenation of at least a portion of the solid coal product to produce additional liquid product comprising the steps of:
   (a) contacting particulate coal with a normally liquid solvent and a catalyst for the solvent refining of coal to form an unsupported hydrogenation coal slurry;
   (b) catalytically solvent refining the coal slurry at elevated temperature and pressure in an initial process stage to form a liquid product containing normally solid refined coal;
   (c) separating the liquid product into a lower boiling liquid product and a normally solid refined coal product containing spent catalyst and ash;
   (d) separating the normally solid refined coal from the spent catalyst and ash;
   (e) contacting the normally solid refined coal with a fresh unsupported hydrogenation catalyst and introducing the mixture into a hydrogenation zone;
   (f) hydrogenating the normally solid refined coal at elevated temperature and pressure to produce additional liquid product;
   (g) separating the liquid product of step (f) from a residual product containing the used hydrogenation catalyst;
   (h) recycling the used hydrogenation catalyst to the solvent refining contact stage of step (a) as the solvent refining catalyst.

2. The invention of claim 1 wherein a portion of the lower boiling liquid product of step (c) is recycled as solvent for the coal slurry of step (a).

3. The invention of claim 1 wherein a portion of the separated liquid product of step (g) is recycled as solvent for the normally solid refined coal of step (e).

4. The invention of claim 1 wherein the separation of step (c) is performed by distillation.

5. The invention of claim 1 wherein the separation of step (g) is performed by distillation.

6. The invention of claim 1 wherein the used hydrogenation catalyst is separated from the residual product by filtration or centrifugation.

7. The invention of claim 6 wherein the residual, non-distillable product separated from the used catalyst is subsequently hydrocracked to produce additional liquid product.

* * * * *

UNITED STATES PATENT AND TRADEMARK OFFICE

CERTIFICATE OF CORRECTION

PATENT NO. : 4,411,767

DATED : October 25, 1983

INVENTOR(S) : Diwakar Garg

It is certified that error appears in the above-identified patent and that said Letters Patent are hereby corrected as shown below:

Column 14, Line 27
Delete "a" and insert therefor -- an unsupported hydrogenation --

Column 14, Line 28
Delete "an unsupported hydrogenation"

Signed and Sealed this

*Twenty-third* Day of *October 1984*

[SEAL]

*Attest:*

GERALD J. MOSSINGHOFF

*Attesting Officer*

*Commissioner of Patents and Trademarks*